US005979354A

United States Patent [19]

Arzola

[11] Patent Number: 5,979,354

[45] Date of Patent: Nov. 9, 1999

[54] SUBMARINE

[76] Inventor: Javier Silvano Arzola, C. Del Reno 4 Los Monteros, 29600 Marbella, Spain

[21] Appl. No.: 08/997,113

[22] Filed: Dec. 23, 1997

[30] Foreign Application Priority Data

Dec. 30, 1996 [GB] United Kingdom ..... 9627029
Jun. 14, 1997 [GB] United Kingdom ..... 9712379

[51] Int. Cl.[6] ..... B63G 8/00

[52] U.S. Cl. ..... 114/312; 114/316; 114/323

[58] Field of Search ..... 114/312, 313, 114/316–322, 330–333, 341, 342

[56] References Cited

U.S. PATENT DOCUMENTS 3,107,641 10/1963 Haynes ..... 114/325
3,171,281 3/1965 Coyle et al. ..... 114/312

OTHER PUBLICATIONS

Burcher and Rydill, Concepts in Submarine Design, 1994, pp. 45, 47, 56–59, 175–178, Cambridge University Press UK.

Clancy, Submarine, 1993, pp. 105, 141, Harper Collins, U.S.

Friedman, U.S. Submarines Since 1945, 1994, pp. 57, 257, Naval Institute Press, U.S.

*Primary Examiner*—Jesus D. Sotelo

*Attorney, Agent, or Firm*—Dorn, McEachran, Jambor & Keating

[57] ABSTRACT

A submarine has a forward pressure hull, an aft pressure hull, and a third pressure hull vessel which is connectable to each of the forward and the aft pressure hulls, wherein the submarine is provided with an array of tubes suitable for launching missiles, the tubes being disposed between the forward and the aft pressure hulls, generally around or adjacent to the center of buoyancy of the submarine.

28 Claims, 9 Drawing Sheets

SUBMARINE

This invention relates to a submarine, notably an attack submarine. The submarine may be nuclear powered or conventionally powered.

BACKGROUND OF THE INVENTION

Most modern submarines constructed in the west utilize a single Pressure Hull configuration with the Main Ballast Tanks (MBT) situated at the fore and aft ends of the submarine. Typically, the reserve of buoyancy (ROB) is in the order of 11% of the surfaced displacement of the boat. A better distribution of weights is achieved by incorporating some of the MBT capacity in a midship location which results in better balance and handling, particularly when the submarine is surfaced. Some older designs (e.g. Skipjack and Permit classes) had such a configuration. However, the incorporation of these tanks was the result of giving the Pressure Hull (PH) a complicated and less than ideal shape in order to withstand deep diving pressure. Where the midship MBTs were located, the PH was narrowed or waisted, thus allowing the resulting space between the PH and the outer hull to be used for MBTs. This narrowing of the hull was accomplished by welding circular conical PH sections to the cylindrical PH sections. This gave rise to undesirable stress areas where the conical sections joined the cylindrical sections and which had to be met with heavy scantlings and bulkheads. In addition, the safety margin offered by a ROB of only 11% is very small. Should an incident take place at depth that produces a breach of the pressure hull and renders inoperative some MBTs, a subsequent emergency blow might be insufficient to establish positive buoyancy and the boat may sink.

Increasing the designed ROB of a submarine and distributing the MBTs over three main areas rather than only two, should reduce the amount of reserve buoyancy that would be lost in such an incident and thus improve the chances of saving the submarine.

Torpedo tubes are usually limited to 4 and are situated in the fore end of the submarine with a complicated system of tanks used to fire the torpedoes and compensate the weight of these with sea water. The torpedo room is located behind these tubes. Space considerations limit the capacity of most American SSNs to about 22 weapons. With the advent of submarine-launched air cruise missiles such as Tomahawk and Harpoon, this capacity was insufficient to ensure an adequate mix of weapons and guarantee the submarine a sufficient minimum number of each type of weapon to meet many mission requirements. In addition, due to the nature of the tactics involved in the use of air cruise missiles (particularly against heavily defended surface ships), there was a need to be able to fire more of these weapons quickly. The 688I class of attack submarines solved this problem by incorporating a Vertical Launch System (VLS) consisting of 12 tubes mounted vertically in the forward MBT area and dedicated exclusively to carrying air cruise missiles. Each tube carries one round and can only be reloaded when the submarine is docked. The new Seawolf class SSNs solves the problem by having 8 torpedo tubes and a capacity of about 48 weapons with the added advantage that these are general purpose tubes which can fire a full range of attack submarine weapons, thus permitting greater flexibility in configuring the weapons mix.

Unfortunately, this increase in weapons-carrying capacity is one of the reasons for the tremendous increase in the size and cost of attack submarines: whereas a Sturgeon class boat displaces some 4700 tons submerged, a 688 displaces 6900 tons and the Seawolf around 9100 tons.

Reloading torpedoes is a rather long process which, in the case of a 688 class submarine, involves dismounting part of the interior floor space to assemble a ramp mechanism on the deck so that weapons can be lowered on a slide to the torpedo room and placed on their respective racks. The entire process of reloading a full weapons load is reputed to take some 12 hours.

Firing a weapon from a torpedo tube also takes rather longer than is desirable. First the weapon must be loaded into the tube and the electrical signal connections made. The breech is closed and water from the Water Round Torpedo (WRT) tank is used to fill the space between the torpedo and the tube. The torpedo is "tested" by the fire control team to ensure it is in working order and the relevant targeting instructions are transmitted to the guidance system. Pressure is equalized with surrounding sea water by opening a slide valve and, finally, the pressure cap and exterior doors are opened and the torpedo can be fired. Once fired, the tube remains filled with water which partly compensates for the weight of the weapon. However, as the weapon is usually heavier than the water it displaces, in order to maintain trim, the Automatic Inboard Venting tank must take on sufficient water to compensate for the difference. If the weapon fired is a wire-guided torpedo, the tube cannot be reloaded unless the decision to cut the wire is taken. Reloading a torpedo tube takes even longer. The muzzle cap and slide valves must be closed and the water from the tube drained into yet another tank called the Torpedo operating Tank situated where it can continue to maintain longitudinal balance and with sufficient capacity to take on all the water required to compensate for the loss of weight which would result if a full load of weapons were discharged. The breech door can now be opened and the tube inspected and cleared of any remaining wires and dispensers before the crew can proceed to reload a new weapon.

There are a number of additional disadvantages to forward-mounted torpedo tube arrangements:

The process of preparing a tube for firing and then actually firing the weapon results in a large amount of noise being generated in the vicinity of the bow sonar which is the main sonar array. This noise causes the sonar to be temporarily "blinded". Furthermore, firing a torpedo from the bow implies having to give it sufficient impulse to overcome the forward speed of the submarine and to ensure that the submarine will not hit the torpedo should its engine fail to start.

Wire-guided torpedoes require that the doors of the torpedo tubes remain open until the wire runs out or the decision is taken to cut it. Since this wire can be over 10 miles long, the submarine may be manoeuvring for a long while with open doors near the bow area which cause a certain amount of turbulent noise. There is also a risk that the wire may rub over the bow sonar casing thus causing more interference.

The acute angles the guidance wire may take with respect to the tube muzzle or the hull door opening may cause the wire to break, particularly during evasive manoeuvres. To reduce this possibility, some torpedoes have a wire dispenser which is attached to the breech end of the tube in addition to a dispenser at the stern of the torpedo. The wire is paid out from both ends in order to reduce its tension. Additional protection for the wire is usually provided by a reinforced "flexhose" which extends through the tube and outside the hull and through which the guidance wire runs. However, there is a risk that this flexhose could later interfere with the closing of the tube pressure cap or hull door.

It can thus be concluded that the traditional location of the torpedo tubes in the vicinity of the bow is undesirable and, furthermore, with the widespread use of guided weapons that do not need to be aimed, unnecessary.

1. Should a major mishap occur in a submerged submarine and it be unable to surface, there is no adequate method of evacuating the crew. Current practice in virtually all submarines (except for the German IKL type 1500 submarines which are equipped with an escape "pod" which can carry the entire crew to the surface) involves the use of "free ascent". Most submarines have at least one escape trunk which can fit 2 or 3 men at a time. The trunk is flooded, pressure equalized with the sea, and the hatch is opened. The crew members in the trunk then float to the surface. The hatch is closed, the trunk is emptied into a tank inside the PH and another 2 or 3 crew members climb inside and the process is repeated. This system can only be used at shallow depths. In addition, surface weather conditions must be taken into consideration. Considering that a 688 class boat carries a crew of about 130 men and is equipped with only two of these trunks, the process of abandoning the submarine in these circumstances is clearly insufficient. The only other rescue method is by the use of specialized rescue submarines (such as the DSRV) of which the U.S.N. has only 2. In case of distress, an emergency buoy is floated to the surface to communicate the location of the submarine. The DSRV is transported by ship or submarine to the vicinity of the distressed submarine where it locates it and attaches itself to one of the escape hatches. Up to 24 crew members can board the DSRV at one time. The DSRV then returns to the assisting ship where it deposits the crew, and returns for another load of men. The main problem with this system is the time necessary to transport the DSRV to the site, locate the submarine and evacuate the entire crew. In addition, rescue can be complicated should the distressed submarine be laying on its side, at an extreme angle or in hostile waters. If the submarine is sinking in deep waters, the crush depth of the hull may be surpassed well before the DSRV can arrive. Thus, the DSRV will only serve for the rescue of the crew whose submarine has bottomed out at less than crush depth.

2. Because the trunk escape system is also the principal method of delivering divers while the submarine is submerged, most submarines are limited to delivering and recovering 2 or 3 divers per trunk at any one time. These trunks can also be fitted to act as decompression chambers. Should the divers require decompression for a length of time before entering the interior atmosphere of the submarine, then the capacity of the trunks may determine the maximum number of divers who may be recovered from an operation. Since there are occasional requirements for submarines to deliver fairly large numbers of divers during covert operations, the process of delivering and recovering these teams requires the submarine to be close to the surface for a considerable length of time, thus increasing the risk of detection. This has led some navies to build a few submarines specially adapted for this sort of mission. Unfortunately, these submarines have necessarily traded off some of their more conventional capabilities in order to meet these requirements.

3. The fairwater sail or bridge fin is a totally undesirable appendage when viewed from any hydrodynamic or hydrostatic aspect or, indeed, from any other aspect including stealth. It causes considerable drag high above the centreline axis which causes a bow-up pitching moment which, in turn, overrides the other hydrodynamic effects on the hull and so determines the settings required on the forward and after hydroplanes to allow the submarine to maintain a straight and level path. When the submarine is heeled into a turn, the bridge fin causes lift which can result in a "snap-roll". For this reason, some Navies have adopted separate two-man control for planes and helm thus increasing crew size. At speed, this fin can generate vortices which produce noise. When surfaced, it is the single most visible and characteristic appendage of a submarine—typically offering over 350 square feet of visible area well above the waterline which announces "submarine" to any observer. It also adds considerable weight topside which is the worst possible place. The hull of a 688 class submarine is about 33 feet in diameter but, because of the bridge fin, draws some 50 feet of water submerged. Furthermore, at periscope depth, the top of the bridge fin is only a few feet under water where wave motion can affect the stability of the submarine and where there is a risk of collision—particularly in crowded coastal waters. The only reason this appendage exists is because it is a convenient place to locate periscopes, antennas, snorkels, and a surface piloting or bridge position. In addition, the location of the control room underneath the bridge fin is dictated by the need to have the periscopes available there. The amount of space required by the periscopes also makes the control room much larger than would otherwise be necessary.

4. Long-range low-frequency sonars are housed in flank arrays. These arrays function best when mounted on constant-diameter sections of the hull, separated as far as possible along the length of the submarine and when recessed into a smooth hull so that flow turbulence is kept to a minimum. However, because of the location of the torpedo tubes, associated tanks and other equipment which crowd the forward MBT area, and the lack of midship MBTs, U.S.N. submarines must mount their flank arrays outside the pressure hull. This results in a bulge on each side of the hull where the arrays are fitted which adds drag and causes flow disturbance around the bulges. The turbulent noise generated causes interference and degrades the effectiveness of these sonars, thereby limiting their use to a short speed range. Furthermore, because the bulges which house these arrays are rather fragile, they are often mounted below the centreline of the hull where they do not protrude beyond the maximum beam of the PH so as to reduce the probability of damage when docking. Placing these arrays in this manner somewhat limits their ability to "listen" for sounds coming from other directions.

5. In many modern attack submarines the lack of habitable space for the crew gives rise to the practice of "hot-bunking". This constriction is related to the small ROB of these submarines. Hot-bunking in a 688I class submarine is reputed to affect about 40% of the junior enlisted personnel. It forces a rigidly set schedule for many berthing spaces which, in turn, tends to dominate the schedules of these crew members. It leads to lack of sleep and to an inflexibility in schedules which, ultimately, must affect the efficiency of the crew. The lack of sufficient berthing and the need of a certain minimum of privacy make submarines the only ships in the U.S. Navy that cannot have women crew members. Naturally, this implies that the Navy must forego fully 50% of all the motivated, intelligent and qualified young citizens who might aspire to crew submarines.

6. In recent years, there has been an increased demand for submarine missions that take place in littoral or shallow waters where the risk of detection is greater. A submerged submarine can leave a wake that is detectable from the air.

The size of this wake increases with greater displacement and speed and less depth. The probability of detection by active sonars and magnetic anomaly detection equipment also increases with greater displacement and less depth. In addition, a submerged submarines' ultimate limitation in navigating shallow waters is its total submerged draught. Among the possible solutions to this dilemma, there should be a requirement for submarines to be smaller and stealthier while not losing any of their "blue-water" capabilities.

It is an object of the present invention to reduce at least some of the above mentioned problems.

SUMMARY OF THE INVENTION

According to the present invention there is provided a submarine which has a forward pressure hull, an aft pressure hull, and a third pressure hull vessel which is connectable to the forward and the aft pressure hulls, wherein the submarine is provided with an array of tubes suitable for launching missiles, the tubes being disposed between the forward and the aft pressure hulls, generally around or adjacent to the centre of buoyancy of the submarine.

With the MBTs distributed over three main areas rather than only two, the amount of reserve buoyancy that would be lost if an MBT were rendered inoperative is reduced, and thus the chances of saving the boat are increased. In addition, by having two pressure hulls, a breach in one of the pressure hulls floods that hull only, not both, because one hull may be sealed off from the other.

The invention permits the external placement of the weapons payload, provision of a multi-purpose escape module and provides for the elimination of the bridge fin. The integration of all the design elements results in a submarine with a broader range of capabilities than comparable contemporary designs, particularly with regard to littoral or shallow-water missions, without, in turn, sacrificing any of the capabilities inherent in those designs.

Preferred embodiments of the submarine offer some or all of the following benefits:

1. A relatively small submarine with a large, flexible weapons capacity, a high rate of fire and reduced weapons reloading time.

2. An inherently safer submarine with a greater redundancy of reserve buoyancy areas and with fewer large openings in the pressure hull.

3. An inherently faster, quieter, more stable and stealthier submarine by eliminating the fairwater sail or bridge fin.

4. A reduction in the manning requirements for weapons operations and ship control.

5. Improved effectiveness of hull-mounted passive sonar systems.

6. An effective emergency escape system for the crew.

7. A more effective system of delivering and recovering underwater covert operations teams.

8. Improved effectiveness of the crew by providing greater habitability and eliminating the need for "hot-bunking".

9. Use, as far as possible, of existing technology and proven construction techniques and with a minimum number of systems that may require extensive research and development.

10. The submarine retains all the mission capabilities of more conventional designs while improving on many of these capabilities.

The two pressure hull configuration should lend itself well to modern modular construction techniques and may give more flexibility in subcontracting than conventional designs. It should also have additional advantages relative to firefighting, survivability against weapons attack and reactor accidents. Other benefits of the invention will become apparent on studying the description of the embodiment below.

It would be possible to have the missile tubes vertical, as in a VLS system, but this would probably necessitate division of the third pressure hull vessel into two parts. For this and other, tactical and strategic, reasons, it is therefore preferred that the missile tubes are generally horizontal, and the invention will be described hereinafter with reference to horizontal missile tubes. However it is to be understood that the invention is not limited to this embodiment.

The third pressure hull vessel is preferably sealable, for example by hatch means, and detachable from the submarine so as to act as an escape system module. For convenience hereinafter, the invention will be described with reference to such an escape system module, but it is to be understood that the invention is not limited to this embodiment.

BRIEF DESCRIPTION OF THE DRAWINGS

The invention will now be further described, by way of example, with reference to the following drawings in which.

DESCRIPTION OF THE PREFERRED EMBODIMENT

Figure 1:
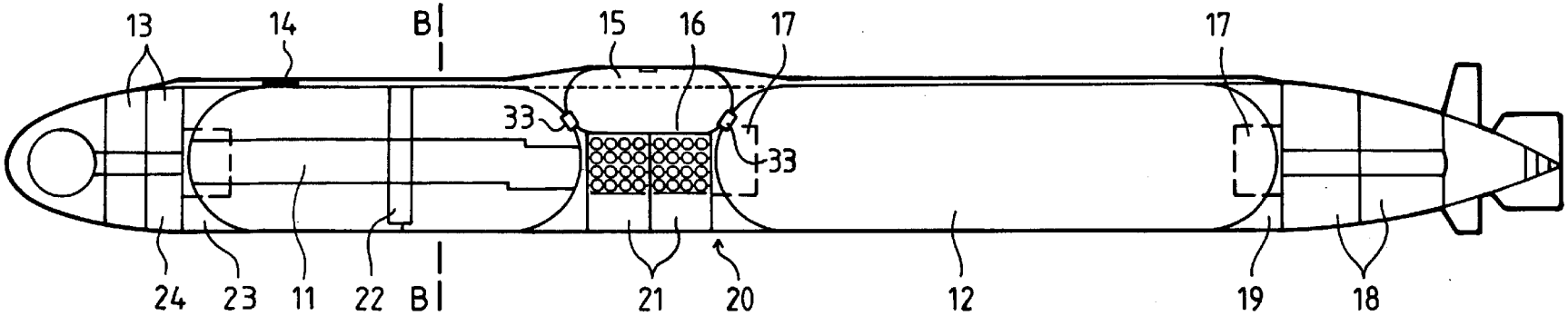
FIG. 1 is a sectional portside view of a submarine in accordance with the present invention.
Figure 2:
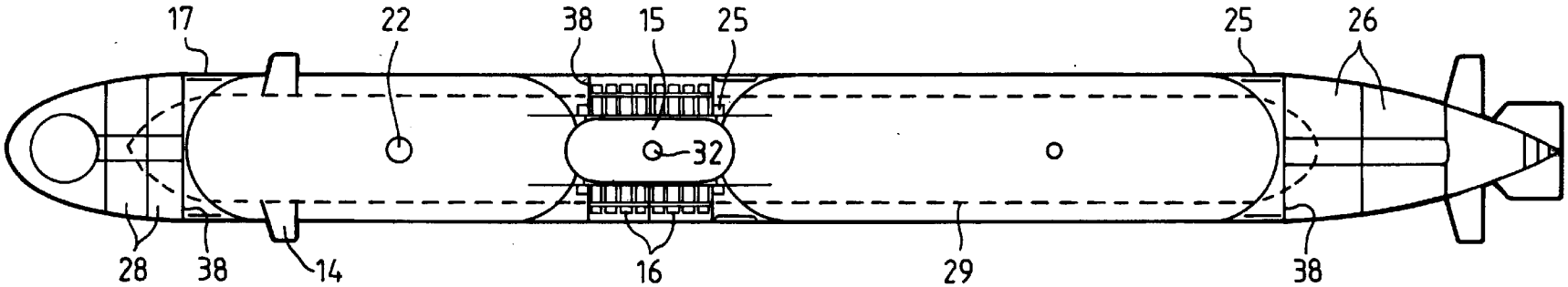
FIG. 2 is a sectional topside view of the submarine of FIG. 1.

The submarine has an external length of about 262 feet. The basis of the design is to have two main pressure hulls 11, 12 make up most of the necessary hull volume of the submarine. Each PH may be of conventional construction, being cylindrical in shape with hemispherical end caps (FIGS. 1 and 2). The smaller, forward PH 11 houses the control room, sonar equipment, navigation and communications equipment, living quarters, galley, mess, stores, torpedo control room, auxiliary generator, batteries, domestic water maker and tank, electrolyzers for making oxygen, forward hydraulic power plant, bilge tank, etc. The larger, aft PH 12 houses all the main propulsion machinery, reactor, manoeuvring room, reactor water maker, aft hydraulic power plant, etc. All the usual elements present in a more conventionally designed SSN are thus present in the two PH vessels except for the torpedo room. Also conspicuous is the absence of a bridge fin which will be discussed below. At the forward end is an MBT area 13 separated into 4 tanks. This area also houses the bow spherical sonar array and the anchor and chain lockers 24 in free-flood areas. At the stern is another MBT area 18 with 4 MBTs, the rudders, after hydroplanes, propeller and shaft. So far, these two areas are perfectly conventional except that there are no torpedo tubes and associated tanks and equipment forward.

The principal innovation in the design comes in the space between the two PH vessels 11, 12. This space should coincide approximately with the longitudinal centre of buoyancy 20 (FIG. 1). A central feature of the design is to adapt the VLS system as used in the 688I class submarines, but with the tubes placed horizontally so it may be called the Horizontal Launch System (HLS) 16. The firing mechanism for the tubes is quite different as it must be a general purpose tube capable of delivering a full range of attack submarine weapons including wire-guided torpedoes, mines and cruise missiles. The length and disposition of the tubes also determines the hull diameter of the submarine. Assuming that a tube requires an interior length of 21 feet, the design calls for a hull diameter of about 25 feet which is approximately the same diameter of the French Rubis and Amethyst class SSNs. A 25-foot diameter PH can contain 2 full decks and three levels. Surrounding the tubes 16 and underneath them are 4 MBT s 21. Above the tubes 16 is a small PH vessel 15 of about 10.5 feet diameter with hemispherical end caps and a hatch leading to the topdeck. This vessel may be called the Escape System Module (ESM) and will be described below.

The Escape System Module (ESM)

Figure 3:
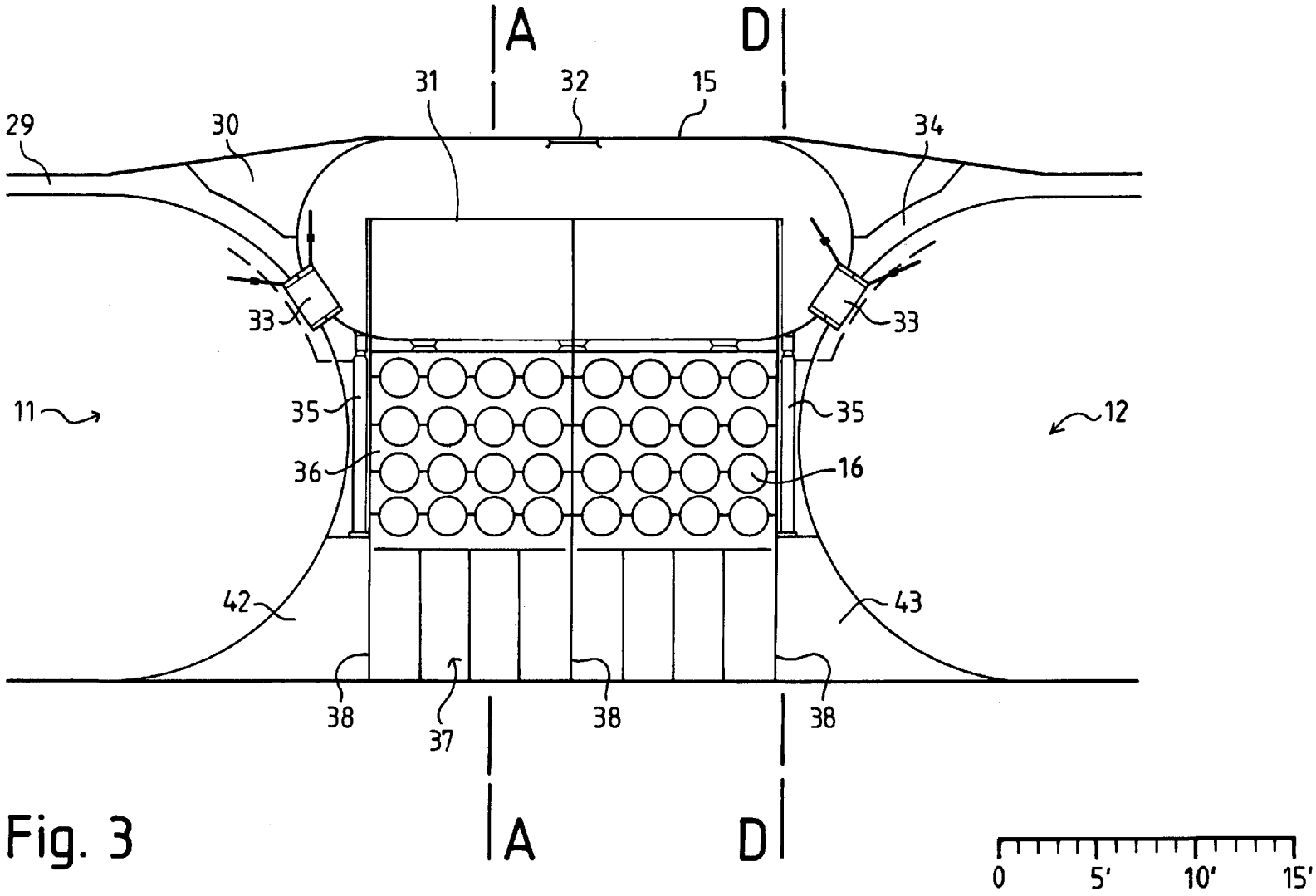
FIG. 3 is a more detailed view of the central portion from FIG. 1.
Figure 4:
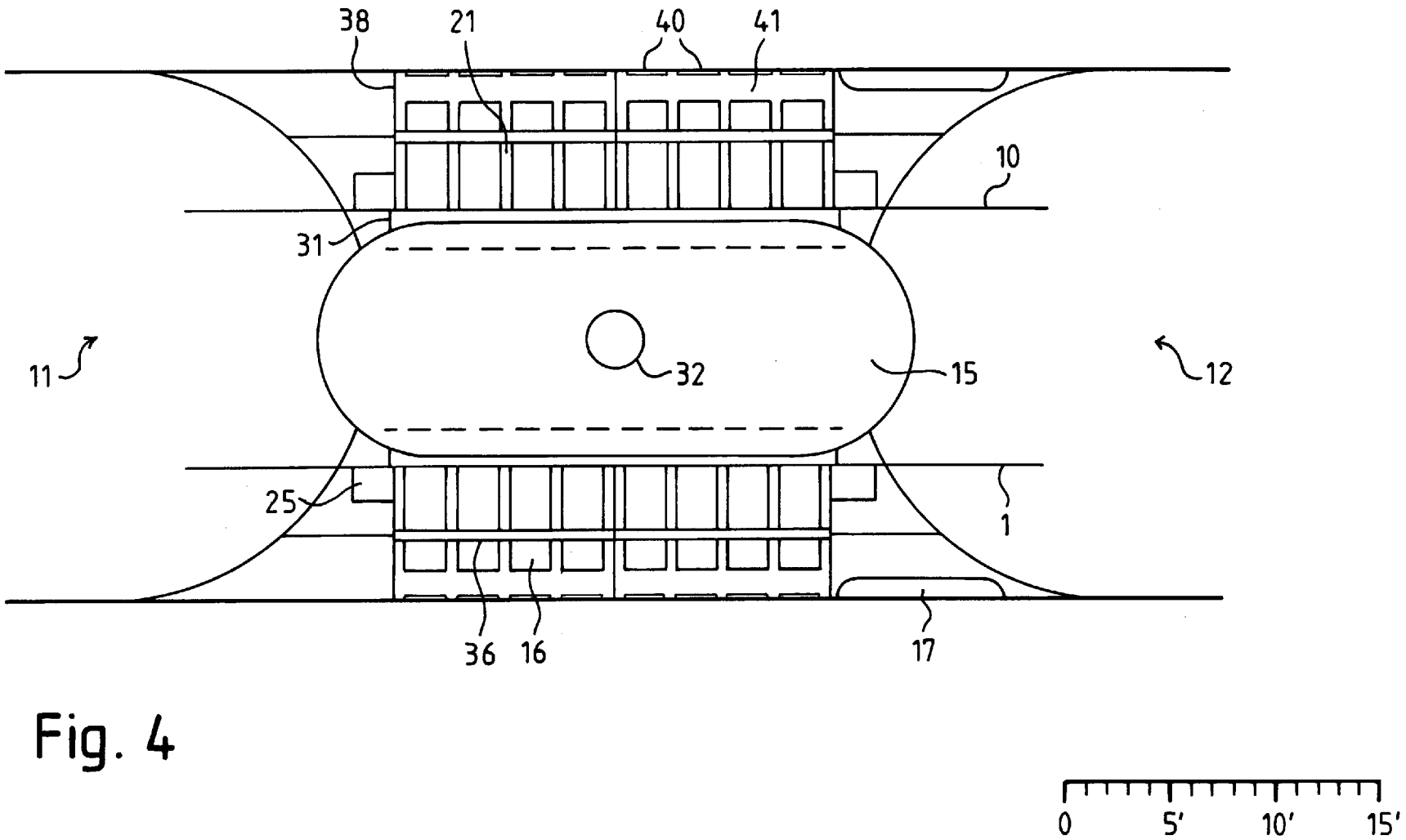
FIG. 4 is a more detailed view of the central portion from FIG. 2.

The ESM 15 should be designed to withstand a significantly greater crush depth than the main Pressure Hulls 11, 12 and should be of sufficient size to ensure that the entire crew plus a reasonable number of "visitors" can fit inside (FIGS. 3 and 4). The hull of the ESM 15 is reinforced by a ring stiffener 44. The ESM 15 is connected via connecting hatches 33 to the two main PH vessels and has several functions:

1. It provides a means for crew and equipment to go from one main PH to the other.

2. It could be used as an escape trunk. A good number of divers could climb inside, the hatches closed, the ESM flooded, pressure equalized with the sea, and the external hatch 32 opened so that the divers could swim out. When recovering divers, the ESM could, if necessary, be used as a decompression chamber.

3. A number of emergency or temporary berths could be set up along the sides of the ESM to accommodate "visitors".

Figure 11:
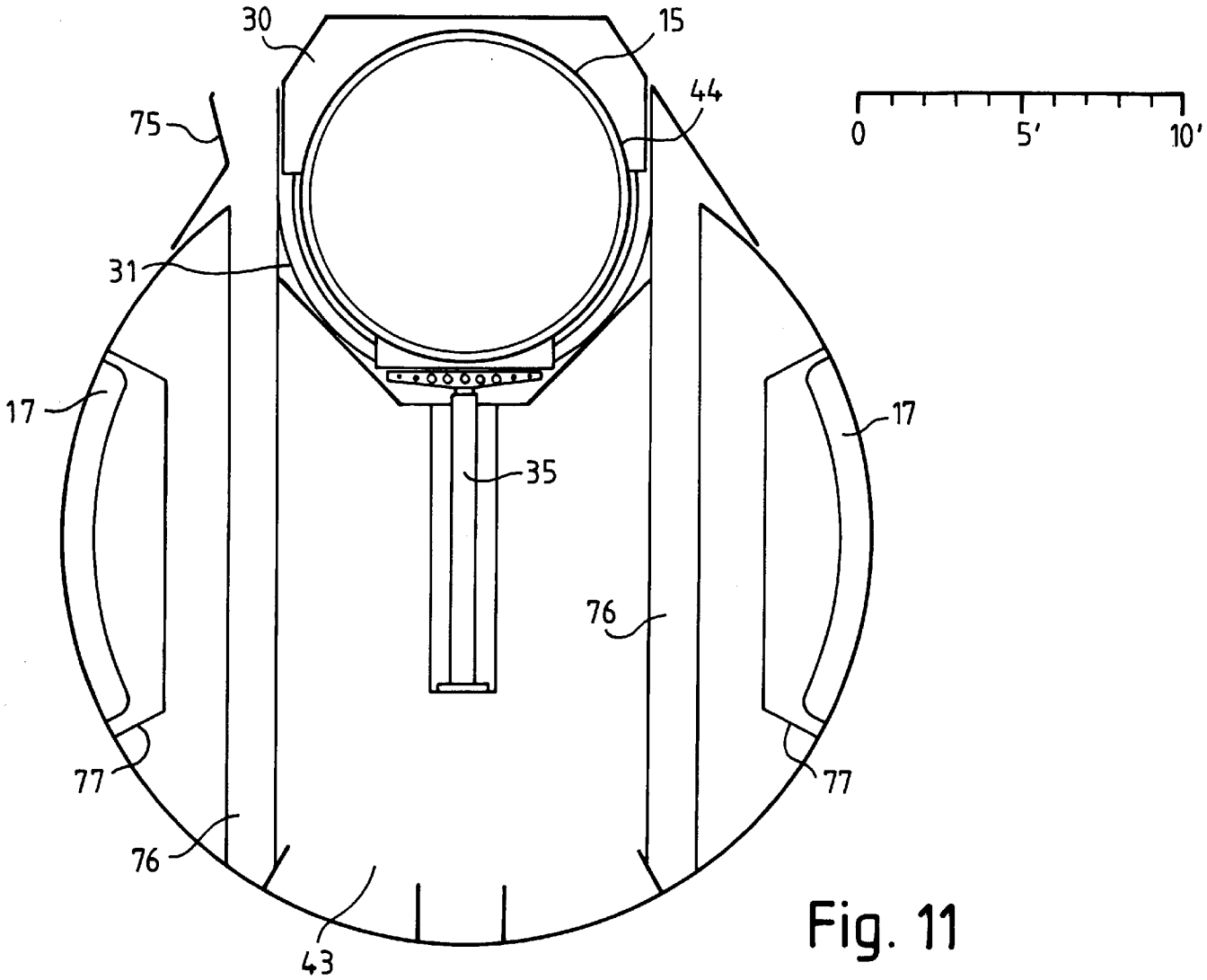
FIG. 11 is a cross sectional view along the line "D" of FIG. 3.

4. In case of an emergency that requires the crew to abandon the submarine, the crew would get into the ESM, close the hatches, flood the space between the hatches, ready the mating or docking mechanism, and then liberate the ESM by unlocking it from the half-cylinder "bed" 31 it is attached to. For this reason it is preferred that the ESM has positive buoyancy, and floats even when fully loaded. The top part of the ESM 15 is surrounded by a superstructure 30 that should be made of a buoyant material that can withstand full sea pressure. To ensure that the ESM will be free to float to the surface from nearly any position or attitude the stricken submarine may have, it is preferred that the submarine is provided with means for lifting the ESM clear of the hull of the submarine. Any suitable lifting means may be provided, for example one or more pistons, explosive charges, rockets, compressed gas charges and the like. In the preferred embodiment illustrated herein, pistons 35 placed underneath the ESM 15 will lift the it so it can clear the submarine hull (FIGS. 3 and 11). FIG. 11 also shows the provision of free flood mast area 76 and mast shutters 75. Longitudinal stiffeners 77 surround the recessed flank arrays 17.

Once on the surface, the buoyant superstructure will help provide stability to the vessel and some form of water-filled keel should be deployed. The ESM should be equipped with emergency rations and equipment sufficient for a few days while the crew awaits rescue.

The emergency evacuation system can be practised non-destructively at sea. A number of crew members must evidently stay behind to tend to the submarine while the rest of the crew practices their abandon-ship manoeuvres. Once the ESM has separated from the submarine, the crew must blow, at least partly, the midship MBTs 21 to compensate for the resultant loss of buoyancy. When flooding the ESM in order to deliver divers, it will also be necessary to partly empty the midship MBTs.

Once the ESM is on the surface, the crew must open the top hatch 32 and place in or over the opening a light hatch or cover with ventilation pipes on the periphery. This hatch or cover will prevent water from entering the vessel in rough seas. The ventilation system will require the deployment of wind or solar generators on the top-deck which can also provide power for lights, radios, etc. In addition, it would be desirable to provide a few inflatable emergency life-rafts, either inside the ESM or in free-flood lockers in the superstructure, which can be deployed in order to alleviate the crowded conditions in the ESM.

Should the submarine be sinking in shallow waters (where the sea bottom is at less than crush depth), the ESM is much superior, in all aspects, to present methods of escape.

Should the submarine be sinking in deep waters, the effectiveness of the ESM will largely depend on the time available to the crew in which to enter the ESM and jettison it before the submarine gets below crush depth, and the time needed by the crew to deploy it. The available time must exceed the time needed for deployment.

The main design factors that determine the available time are:

1. The average sink rate that would result from different likely scenarios and, most specially, if the after PH were flooded and the propulsion machinery stopped. In order to slow down the sink rate, the total reserve buoyancy available from all sources should be as large as possible. It may be necessary to deploy balloons filled with HP air and tethered to hull.

2. The difference between the submarine's depth when the abandon-ship order is given and the crush depth. It must be assumed that such an order would be given while the submarine is at test depth, therefore the safety margin between test and crush depth should be as large as possible.

The main design factor that determines the deployment time is the number of persons on board. The fact that most of these would probably enter the ESM from the forward PH 11 and the possibility of additional complications such as fire, injured crew and severe pitch or heel angles, would all add to the length of time needed for deployment.

Although good training will evidently help shorten deployment time, the number of crew and other persons should be kept to a minimum. A case study may help understanding: Assume a submarine with a test depth of 1000 feet, a crush depth of 2000 feet and a total of 80 people on board. The aft PH 12 is flooded, the machinery stopped, and the boat is sinking stern-end down. The order is given to abandon ship when the forward PH 11 is at test depth. The first few people inside the ESM 15 can help the rest in and an average of 8 people per minute should be achievable. If 90% of these people are entering the ESM from the forward PH and one minute is needed to ready the ESM for ejection, then a total of 10 minutes are needed to deploy the ESM. The average sink rate must then be less than 100 feet per minute to provide at least 10 minutes of available time.

Other considerations

The pistons 35 destined to lift the ESM clear of the hull may be operated by high pressure air (HP air), hydraulic fluid, gas generators or explosive charges. At least two different systems should be used to ensure the availability of a backup.

It should be pointed out that the ESM receives additional protection from weapons attack by most of it being surrounded by the midship MBT structures 21.

It should also be mentioned that the attachment or docking hatches between the ESM and the two main PHs need a design that will secure the passageway against deep diving pressure and yet permit the release of the ESM when required. The problem arises because these passageways are at an angle of about 35 degrees with respect to the horizontal and a design is needed to ensure that the ESM is free to float to the surface without interference from the mating or "docking" mechanisms. It may be possible to adapt a lock-out mating hatch system similar to the one used in DSRVs.

Should it be determined to equip the submarine with emergency balloons as a last-ditch method of providing buoyancy, these may be housed in the forward and after MBT areas and/or in the submarines' superstructure. Care must be taken to ensure that these do not interfere with the ESM after ejection.

While using the ESM as a decompression chamber, it will, of course, be closed to all through traffic. However, because most likely scenarios require fairly brief decompression times, this vessel would be closed for relatively short periods, which should not disrupt the normal operation of the submarine.

In order to avoid as many large openings in the PHs as possible, ventilation in the ESM, while in normal use, should, if possible, be provided through the access hatches. This may require that a small air pressure differential between the two main PHs be maintained so that an air current through the ESM can be established. The venting of various tanks inside the PH creates a tendency for air pressure in all submarines to build up while submerged. Excess air is usually removed by air compressors. It may be possible to take advantage of this "natural" build up to help establish this pressure differential which could be reversed periodically. Fans in the ESM may aid in ensuring that no dead-air pockets are created.

Alternatively, ventilation should be provided by small through-hull fittings that will close on detachment of the ESM.

In a preferred embodiment, the ESM may be fitted with propulsion means and control system or systems. The ESM could therefore have many more uses than those set forth above. A secondary "tunnel" to connect the two main PHs may then be fitted under the HLS.

The Horizontal Launch System (HLS)

By having the HLS 16 outside the pressure hull and incorporated into the midship MBTs 21, the potential size of the HLS is now largely dependant on the size of these MBTs and so, indirectly, on the ROB. For a 25-foot-diameter hull, the HLS offers an increase in firepower of at least 60% over conventional designs and I estimate that at least 40 tubes can be incorporated without running into impractical sizes for the forward and after MBTs 13, 18, without placing too much reliance on the midship MBTs 21 and without creating an excessively large ESM.

In most submarines, torpedoes are fired using HP air which drives a piston that forces pressurized water from the Torpedo Discharge Tanks to enter the tube through some slide valves. An older method, now in disuse, was to blow HP air directly into the tube thus creating a large bubble inside it. Care had to be taken to avoid blowing so much air that some could escape from the tube and give away the position of the submarine. After firing, a valve was opened that would vent the tube into a special tank thus letting it be filled with water again. In the VLS system used in the 688I class submarines, an explosive charge or gas generator ejects the missile and the tube fills with water to compensate for the weight of the weapon. For the HLS, a conventional torpedo tube system requires too much space and is unnecessarily complex for a tube that cannot be reloaded except when the submarine is docked with a Tender, while the VLS system is far too indiscreet for firing torpedoes or laying mines.

Figure 7:
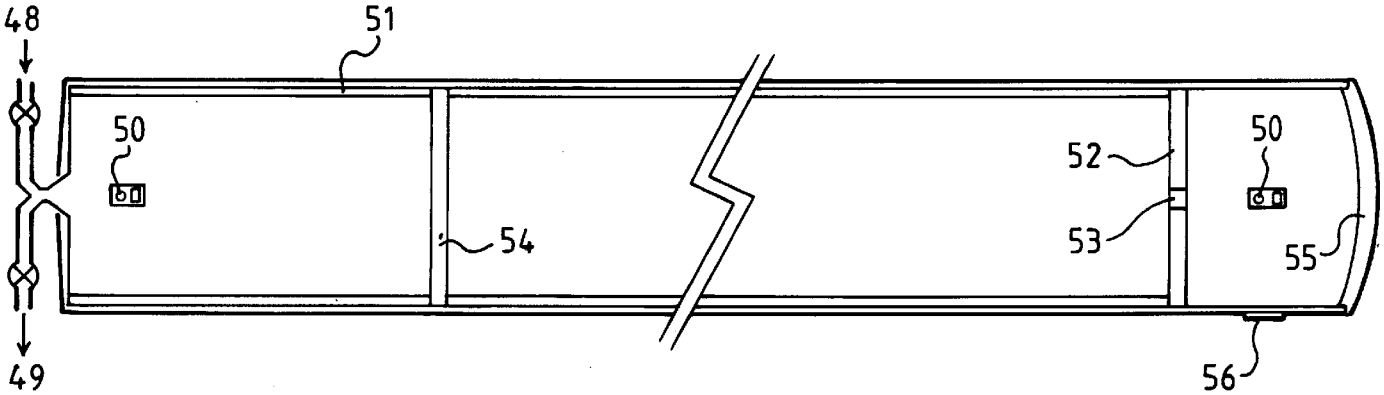
FIG. 7 is a topside view of a missile tube for a submarine in accordance with the present invention.
Figure 8:
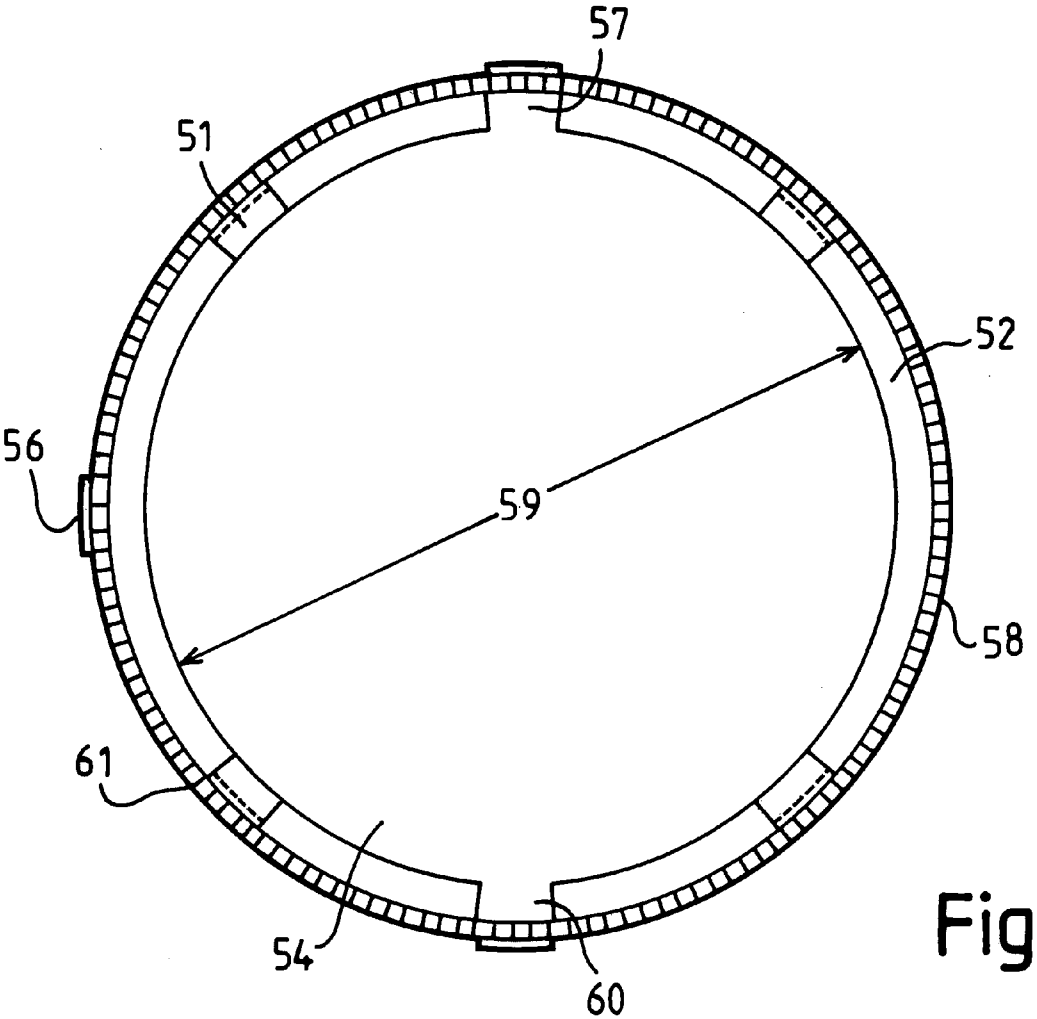
FIG. 8 is a cross sectional view of the tube shown in FIG. 7.
Figure 8A:
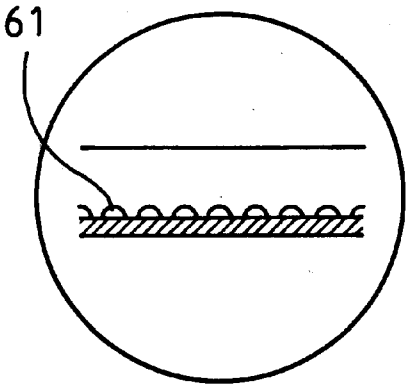
FIG. 8*a* shows an enlarged detail of the tube of FIG. 8.

I propose a system whereby HP air blown directly into the rear of the tube drives a plate 57 that pushes the weapon into the ocean (FIGS. 7 and 8). The tube 16 has an internal diameter 59 of about 21 inches. Near the muzzle end of the tube, the plate 57 may hit a stop which is a thick ring 52 having a gap 53 that narrows the tube to the diameter of a conventional torpedo tube. This would ensure that no air escapes the tube. Immediately after firing, valves behind the opening at the rear of the tube would switch from the HP air system 48 to a vent system 49 that would collect the air as the plate 54 is pushed back by sea pressure. The tube stays filled with water to partly compensate for the weight of the weapon. A Weapons Compensation (WC) tank system 37, placed below the HLS array (FIGS. 3 and 5), would compensate for any difference between the weight of the weapon and the sea water that displaced it.

There are two possibilities for storing the weapons inside the tubes: a "dry" and a "wet" tube option. Both are essentially similar although the "dry" option is somewhat more complex.

The "dry" tube option

The tubes have an inside diameter somewhat larger than a conventional torpedo tube with thicker guide rails 51. The guide rails 15 have channels 61 therein for air bubbles. The push plate 54 has grooves in its perimeter to fit the guide rails. The plate stop is actually two ring sections 52 that leave openings at the top and bottom of the tube. The bottom opening 60 is located behind the signal connectors, while the top one 57 is behind one of the WRT tank fill valves 50. At the rear of the tube and just in front of the push plate 54, there is another WRT tank fill valve 50. Because the tube lies horizontal to the centreline of the submarine, a fill valve 50 must be placed at the top of each end of the tube to ensure that it fills completely with water from the WRT tanks before opening the pressure cap.

Wire-guided torpedoes would have some of their wire travel from the dispenser up the outside of the torpedo where it would be held in place against the body of the torpedo by a length of tape (or some other not very strong adhesive), and connected to the submarines' fire-control system at the connector near the muzzle of the tube. The plate stop 52 has an opening 60 to allow the wire to pass to the connector. When the torpedo is fired, and as it comes out of the tube, the connector will hold the wire fast and pull it free along with the tare or adhesive that holds it in place against the body of the torpedo. The length of wire taped to the torpedo body should be reinforced.

The procedure to reload the HLS is as follows (use FIG. 5 to visualize the process):

1. The minimum number of crew should be on board during this manoeuvre. A hull systems operator and a torpedo operations specialist are needed for executing this operation.

2. All MBTs, Trim and Compensation tanks, "D" tanks, etc . . . should be empty so as to raise the vertical centre of gravity as much as possible.

3. To reload, say, the tubes that open to starboard, first flood the portside MBTs 28 and, possibly, the ESM 15. If the boat was designed with a sufficient ROB, the centre of gravity should shift far enough portside that the submarine will roll over on its side presenting the starboard side tube doors in a vertical position.

4. Open the starboard tubes' pressure caps 55 and doors 40. If the tube is full of seawater, the assisting Tender will lower a hose into the tube and pump it out.

5. The Tender will, with the use of a crane, extract and/or insert the prescribed weapons into their respective tubes. Marks painted on the weapon and on the muzzle of the tube will help in introducing the weapon correctly so that all connections with the fire control system can be made correctly. If the weapon is a wire-guided torpedo, the wire taped to the body of the torpedo will fit through the gap in the plate stop 52.

6. A technician will manually connect the new weapons to the connectors near the muzzle of their tubes. In the case of wire-guided torpedoes, the end of the guidance wire will also be connected.

7. The torpedo operations specialist on board should test that the weapons have been loaded correctly and that the fire-control system recognizes each weapon correctly.

8. A maintenance and inspection team may use the occasion to check the various mechanisms accessible through the open doors.

9. Close the starboard tubes' caps and doors.

10. Blow the portside MBTs 28 and the boat should right itself.

11. Repeat steps 3 through 10, but flooding the starboard MBTs 26 to reload the portside tubes.

For an equivalent number of weapons, a full reload operation should take less time than a conventional system. The crew members that must remain on board during a weapons reload manoeuvre will require special provision for their positions in order to ensure that this manoeuvre can be carried out safely and efficiently. In addition, some study should be given to determine what the minimum on-board crew should be during this manoeuvre that will ensure adequate safety and security standards.

Because most submarine systems are not built or designed to operate at heel angles of more than some 50 degrees, all non-essential systems should be shutdown during this manoeuvre and provision will have to be taken to ensure that a general cleanup or expensive repairs will not be necessary after every reload operation. Even so, it is likely that some equipment will require some redesign in order to ensure that no damage will result from laying the submarine on its side. In addition, some study should be given towards minimizing the amount of time necessary to prepare the submarine for this operation.

Figure 5:
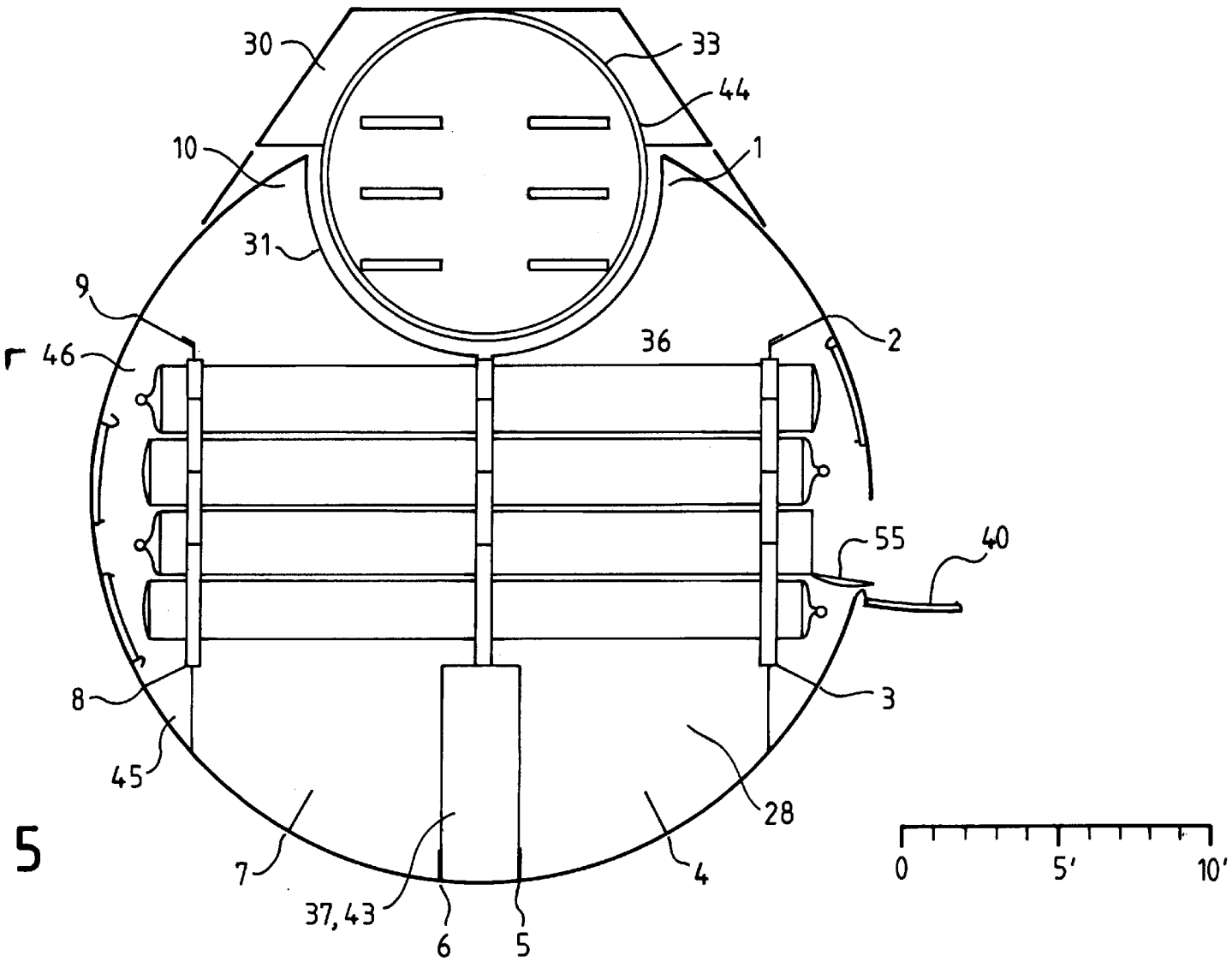
FIG. 5 is a cross sectional view along the line "A" of FIG. 3.

Because it is important that the HLS tubes be as densely packed as possible while still leaving enough space between them to permit water in the surrounding MBTs to enter and exit freely, and yet permitting basic maintenance to be carried out on the various tube mechanisms without having to go to dry dock, the arrangement of the HLS needs special consideration. As can be seen in FIG. 5, half the tube doors open to starboard and half to port. The tubes are stacked in four rows arranged symmetrically around the longitudinal centreline of the hull. Both ends of each tube are in free-flood areas 46 that house the HP air lines, air vent lines, WRT tank connections, electrical signal connections, valves and the mechanisms for operating the pressure caps and hull doors. In this manner, all the elements that may need periodic routine inspection and maintenance are accessible from the door openings.

The procedure for firing a weapon such as a wire-guided torpedo is a s follows:

1. Flood the tube from the WRT tanks situated above the HLS array (WRT tanks are not shown).

2. Equalize pressure inside the tube with the sea by opening a slide valve 56 near the muzzle and then open the muzzle pressure cap 55 and the hull door 40.

3. The fire-control section checks and arms the torpedo and transmits target information to the guidance system.

4. The torpedo can now be fired.

A firing order would take a fraction of the time a conventional system takes and, in theory, the only limitation to the number of weapons that can be fired in quick succession is the number of weapons carried. If, after preparing a tube for firing, the decision is taken to "stand-down" the weapon, there is no provision for emptying the tube—it can remain full of water until needed again or the submarine is docked with a Tender.

Provision will have to be made for compressibility effects on the tubes to ensure that:

1. The push plate 54 does not bind in the tube. One possible solution is to leave a large enough gap between the plate 54 and the tube walls 58 and to place angled stiff rubber "blades"—similar to the windscreen wiper blades of an automobile—on the edges of the plate. The blades would respond to the compression of the tube walls 58 by flattening so that an air-tight fit is always provided.

2. The tubes themselves do not loosen from their supporting structures—particularly from the "yokes" 36 described below in the HLS Assembly section.

The "wet" tube option:

The only reason for providing WRT tanks is to keep the tubes "dry" so as to prevent corrosion during the rather long periods the weapons may be in the tubes. One method whereby these tanks may be eliminated, would be to completely fill the tubes with a corrosion-retarding fresh-water solution when the weapons are loaded in the tubes. Once the pressure cap 55 is closed, the weapon would be immersed in a corrosion-free environment at only one atmosphere pressure. This option has several advantages:

1. The firing sequence would be shortened by eliminating point 1 from the firing procedure described above.

2. Compressibility effects could be largely ignored and the tube construction could be lighter.

3. The WRT tanks and their corresponding equipment could be dispensed with, thus simplifying the system.

4. If, after preparing a tube for firing, the decision to "stand-down" is taken, there is less risk of subsequent corrosion than with the "dry" tube option.

5. The risks associated with a fuel spill would be reduced because the weapon is immersed and not surrounded by an oxidising atmosphere and because there are few rubber seals which may deteriorate.

In order to ensure that no air is trapped in the tubes, the valves at the top of the tubes (no longer connected to WRT tanks but open to the ocean may need to be opened for a while after completing a reload manoeuvre. The small amount of sea water that may enter should not be cause for concern about corrosion.

Care must be taken to ensure that the corrosion-retarding solution cannot react negatively in case of a fuel spill nor become a means whereby the position of the submarine could be detected. An anti-freeze and distilled water solution (as used in automobile engines) may be an adequate possibility.

Other considerations

With regard to the hydrostatic stability of the submarine, since the tubes are arranged symmetrically around the centreline of the submarine, consideration should be given to the relative densities of the weapons before deciding which tubes will carry which weapons. Since the WC tanks are placed below the HLS, the firing of heavy torpedoes from any tube can only result in a slight increase in the distance between the centre of buoyancy and the centre of gravity (BG) which would only add more stability to the submarine. However, if a large load of lightweight weapons be carried (weapons whose weight is significantly less than the weight of the volume of water they displace), then consideration to the firing sequence must be given in order to avoid possible stability problems.

There should be sufficient clearance around the weapons to ensure that an optional swim-out launching mode should also be possible for torpedoes. However, it is likely that a restrictive speed limitation would then have to be observed in order to avoid damage to the weapon as it enters perpendicularly into the flow of water. Similarly, a weapon fired while the submarine is travelling at speed will experience a large toppling moment as it emerges from the tube. This effect will require considerable study to ensure that the weapon will not suffer damage—particularly when the submarine is travelling at high speeds. It is likely that another speed limitation will have to be observed for active launching—although higher than for the swim-out mode. It should also be mentioned that, to a lesser extent, this toppling moment is also experienced in American SSNs which have their bow tubes angled so as to clear the bow sonar.

With regard to short weapons such as certain mines, it would be desirable to be able to fit two such weapons inside each tube. Since these weapons are normally launched while the submarine is travelling slowly, it should be possible to incorporate a mechanism that would permit this feature. However, it is likely that the tubes may then have to be longer than is contemplated here and the hull diameter would have to be correspondingly larger.

A method to hold weapons in place inside the tubes is necessary to prevent them from sliding around inside the tubes when the submarine heels. This mechanism must obviously have to release the weapons for firing and reloading. It is possible that a simple brake device, placed near the tube muzzle and mechanically activated by the opening and closing of the pressure caps, would suffice.

One interesting possibility the HLS has is that, should the submarine be travelling slowly, say 3 or 4 knots, it should be possible to heel the boat to a sufficient angle so that a heavy torpedo or mine will slide out of the tube silently (or, at most, with only a gentle "kick"). This exercise would probably work best on those tubes whose caps and doors open topside.

For simplicity, the drawings contemplate a mechanism based on the hydraulic one used now in the VLS for operating the tube caps and doors. However it would be very desirable to develop a mechanism which would open the doors and caps on the inside of the hull—particularly for wire-guided torpedoes that require these doors to remain open for extended periods of time. This would reduce turbulence and drag, facilitate the "slide-out" launch method and reduce the possibility of breaking guidance wires. Unfortunately, likely alternatives have drawbacks: a hinged double-door mechanism would require a slightly larger hull diameter than is contemplated here and would be somewhat more complex. Similarly, a system whereby the doors slide open on the inside of the hull may not require more hull diameter, but would be much more complex and is likely to add complexity to the midship hull structures.

It is likely that this design will exclude the use of tube-mounted dispensers for wire-guided torpedoes so that tension on the wire as it is paid out will be greater and its total length limited to that available on the torpedo dispenser. However, because of the position of the tubes near the centre of gravity of the submarine, the wide angles available for the wire relative to the hull and the lack of a bridge fin, the risk of breaking the wire should be lower than for conventional forward-mounted tube designs. Furthermore, the problems associated with the flexhose and tube-mounted dispenser are avoided.

Compared to conventional indirect piston systems, the direct-ejection system proposed in this paper should be more efficient. The HLS should also have lower crew and space requirements and should produce less noise in its operations than a conventional torpedo room.

It should be mentioned that, because firing wire-guided torpedoes from a midship position will probably increase the risk of the wire fouling or being cut by an open single-screw propeller, a shrouded pump-jet type propulsor would be desirable for the submarine. Since these are now considered superior to open single-screw arrangements, this is an additional point in favour of these propulsors.

The HLS Assembly

Because it may be desirable to occasionally inspect the tubes fully or even remove them, provision for dismantling the HLS array and removing the tubes while the submarine is in dry dock may be necessary. A discussion of the process also explains the assembly. FIGS. 3 and 4 show that there are 3 transverse bulkheads 38 that divide the space into 4 areas. The two interior areas hold the MBTs 21 and the HLS array 16. FIG. 5 shows that there are 10 main longitudinal stiffeners 1 to 10 welded to the inside of the hull and to the main PHs 11, 12. Starting from the top of the hull and going in a clockwise direction, these are numbered 1 through 10. A simplified description of the dismantling process is as follows:

1. Remove the ESM 15.

2. Unbolt the ESM bed 31 from stiffeners 1 and 10, the longitudinal "bulkhead" underneath formed by the central yokes 36, supported by vertical supports 45, and the three transverse bulkheads 38. It can now be lifted out.

3. Remove the tube doors and any equipment that lies above the HLS array such as WRT tanks, HP air bottles, etc. Loosen all the connections to the tubes.

4. Unbolt the end torpedo yokes 36 from stiffeners 2 and 9.

5. Unbolt the top row yokes 36 from the yokes 36 beneath and from the transverse bulkheads 38. The top six yokes can now be lifted out through the opening at the top where the ESM bed was.

6. The top row of tubes can now be removed through their door openings.

7. Repeat steps 5 and 6 until all tubes are removed.

As can be appreciated, the yokes 36 not only support the tubes 16 but also form the longitudinal separation between the starboard 26 and port 28 MBTs and the separation between the MBTs and the FF areas 46 near the ends of the tubes. It should also be pointed out that the ESM bed 31 is actually the hull separation between the MBTs and the ocean. The small space between the ESM and the bed is free-flooding.

Figure 6:
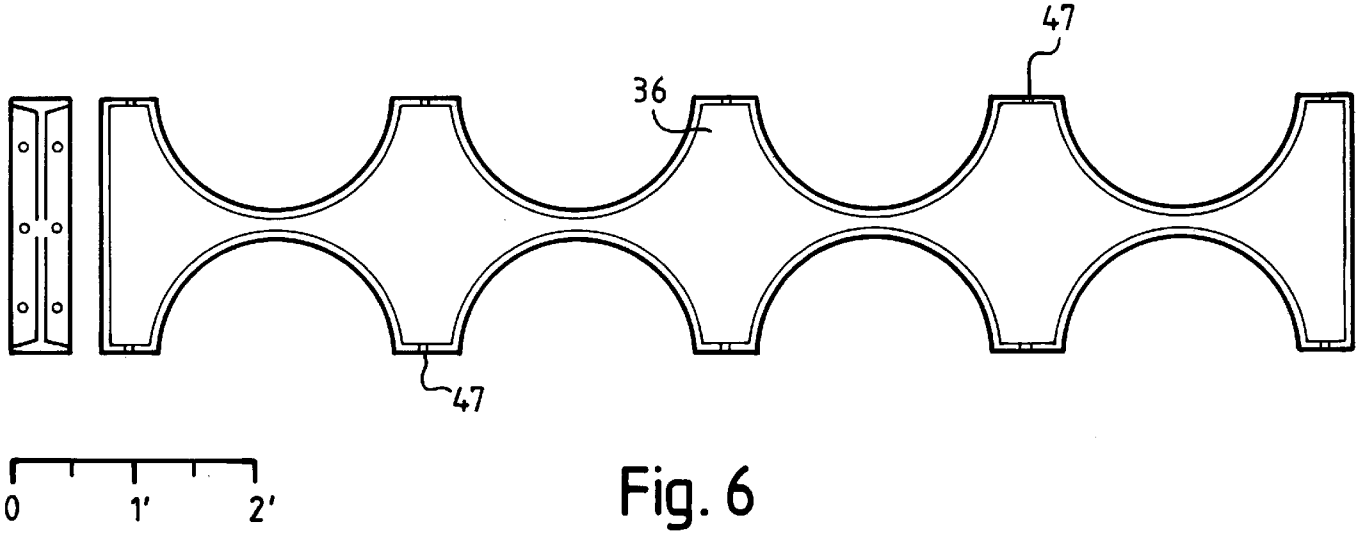
FIG. 6 shows the yoke for a missile launching system in accordance with one aspect of the present invention.

All the elements inside the midship MBTs 21 are either round or shaped and placed so they will not trap air pockets. FIG. 6 shows a yoke 36 in more detail. The flanges around the perimeter of the yokes 36 are faired towards the ends so as to minimize trapping of air. The yoke 36 has bolt holes 47 for securing the yokes each other and/or to transverse bulkheads 38.

Should it be determined that it will never be necessary to remove the tubes, the yokes and bed can be designed to be welded to the tubes and structures. This may result in a lighter structure.

Periscopes, snorkels and Other Masts

The U.S.N. is reputed to be experimenting with non-penetrating mast periscopes. Presumably, the idea is to put cameras and other electro-optical devices at the end of a periscope and to see through a CRT monitor rather than an eyepiece. The periscopes can be somewhere else rather than directly above the control room. This permits a much more flexible location for the control room as well as a smaller control room where, at present, the periscopes take up much space. In addition, a non-penetrating periscope should have a longer extension, thus permitting the submarine to be at a somewhat greater depth when using this device.

Each of the 4 PH hemispherical end caps is enclosed by a transverse bulkhead 38 situated a short distance away from the end cap (FIG. 2 show all these areas, FIG. 4 offers more detail). There are 8 spaces between these bulkheads, the PH end caps, and outboard of stiffeners 1 and 10 which can be made free-flooding and can be used to house the periscopes, snorkels, antennas and all the other masts that would normally be housed in the bridge fin of a more conventional submarine. FIG. 11 shows that, for a hull diameter of 25 feet, there is a useful height of over 20 feet in those parts of the hull.

Although some single-PH submarine designs could have up to 4 of these areas which could be used for masts, the total free-flood space available may be insufficient to house all the different masts which are required.

It should also be pointed out that, by locating a snorkel next to an MBT area, using it to "fan" the MBTs empty would be a much more efficient operation than in a conventional design where the air from the snorkel has to go through the pressure hull before it can reach the MBTs.

The Extendable Surface Piloting Bridge (ESPB)

Although the design eliminates the need for a bridge fin to house periscopes, antennas, snorkels and other masts, there is still a need to provide a surface piloting or bridge position for when the submarine is navigating on the surface. This position must be high enough to give good visibility all around the boat, it must be accessible from the interior of the submarine and the topdeck, it must shelter the occupants from the elements and it must be equipped with sufficient communication and navigation aids for surface piloting. It should also have the minimum size that would permit at least three persons to conn the surfaced submarine.

Figure 10:
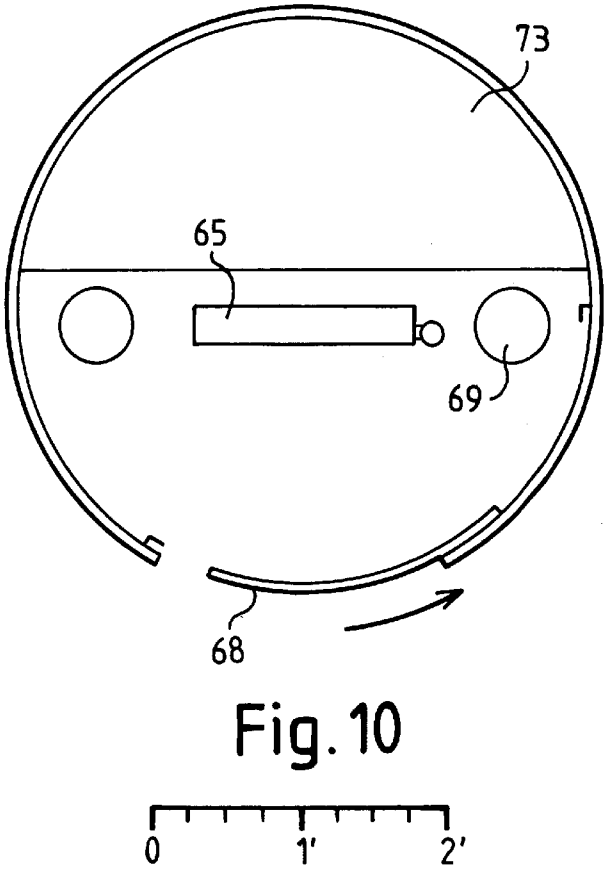
FIG. 10 is a cross sectional view on the line "C" in FIG. 9*a*.
Figure 9A:
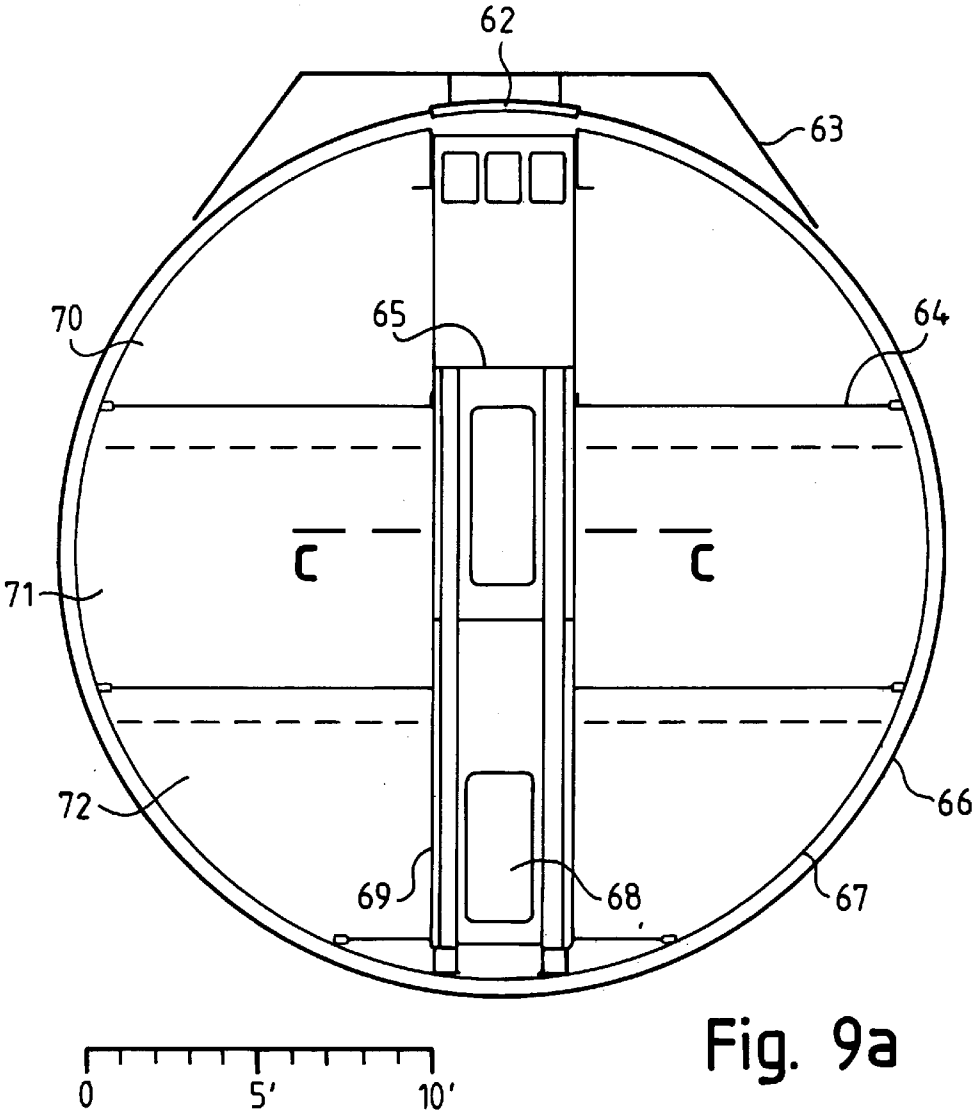
FIG. 9*a* is a cross sectional view of the extendable surface piloting bridge shown on the line "B" in FIG. 1.
Figure 9B:
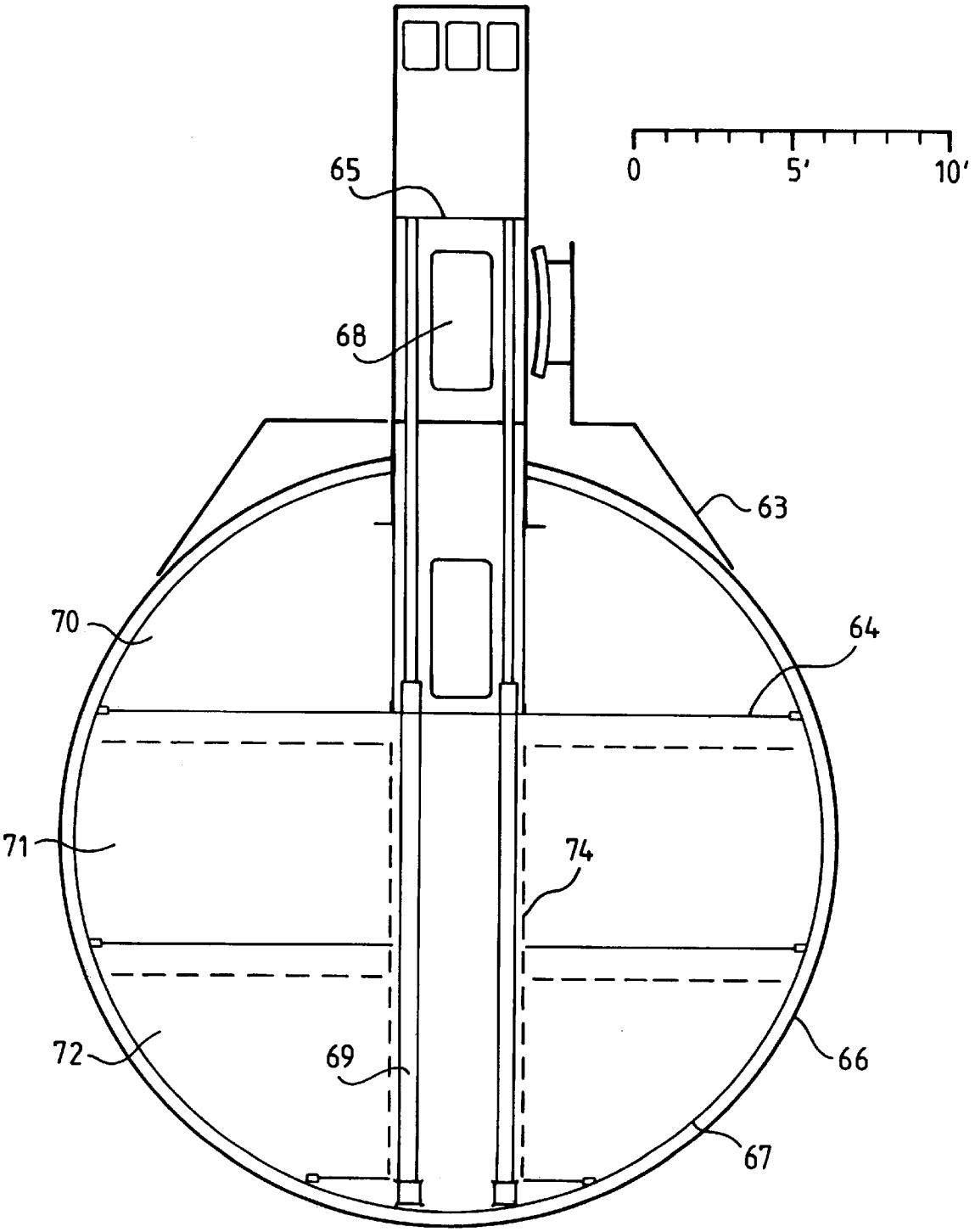
FIG. 9*b* is a cross sectional view similar to that of FIG. 9*a*, but with the bridge in an extended position.

In the forward PH 11, a closed tube 22 mounted vertically on the axis of the boat extends from the top of the PH to nearly the bottom (FIG. 1). This tube 22 may be called the Extendable Surface Piloting Bridge (ESPB). The interior of the ESPB 22 has a ladder 65 and a hydraulic mechanism 69 to raise and lower the assembly (FIGS. 9, 9*b* and 10. Above the ESPB 22 is a large hatch 62 that, when opened, permits the ESPB to be extended when the submarine is surfaced. The ESPB has two aft-facing doors 68 which slide open on the inside of the tube 22. When the ESPB is retracted, the bottom door 68 opens to the lower level 72 of the submarine and the upper door opens to a landing between the middle 71 and upper 70 levels. When the submarine is surfaced, the tube 22 can be extended to a maximum of about 15 feet of which about 13 feet rise above the topdeck (a 25-foot-diameter hull is assumed). When the ESPB is fully extended, the upper door opens to the topdeck and the lower door opens to the deck 64 on the upper level 70 inside the hull 66.

The ESPB has three levels. The upper two levels are equipped with windows. At the top level, two persons may stand on a platform 73 forward of the ladder 65 and a third lookout may stand astride over the opening for the ladder. At the middle level of the ESPB, behind the upper sliding door, a small platform forward of the ladder provides a secondary lookout position for when the tube is fully extended. To access this position, that section of the ladder can be swung open like a door. There is space for some light stores in the area forward of the ladder at the bottom level. For obvious safety reasons, the tube 22 should be sheathed by a sheath 74 at the middle and lower levels of the submarine—except for the door openings. When fully retracted, the ladder 65 may be used for communicating between the lower level 72 of the submarine and the levels above.

To avoid water entering the boat when the ESPB is extended and the topdeck is awash, seals such as rubber "O" rings can be placed on the structure that protrudes below the hatch. In this way, it should be possible to extend or retract the ESPB even when the submarine is not completely surfaced. The small amount of water that may come inside could be channelled to the bilge. Some care should be taken with the forward speed of the submarine during this manoeuvre in order to guard against the loads caused by the flow of water.

The roof of the ESPB tube has a light hatch 62 to permit access to the topdeck when surfaced with the ESPB retracted. This hatch also provides backup access to the main hatch mechanisms.

A lower limit of about 4 feet for the diameter of the ESPB is preferred. Mention should also be made of the possibility of removing the ESPB while in port to leave a very convenient large-diameter access hole for outfitting and refits.

Other systems

Flank sonar arrays

The spaces enclosed by the aforementioned transverse bulkheads 38 and the PH end caps can also be used to house the recessed flank sonar arrays 17—particularly between stiffeners 2 and 3 (port side) and 8 and 9 (starboard side) where they can be placed symmetrically along the longitudinal axis of the submarine (FIGS. 1 and 2 show the arrays, FIGS. 5 and 11 show the stiffeners). Additional sonar equipment may be placed above and below these stiffeners in order to maximize the potential of capturing "bounced" or reflected sounds. As can be appreciated, up to 8 arrays can thus be incorporated: 2 in the forward section, 2 in the after section and 4 in the midship section (2 just forward of the HLS and another 2 just after it).

Launching weapons from the HLS will undoubtedly interfere with the operation of the midship flank arrays. However, compared to conventional forward-mounted tube arrangements, the design significantly reduces interference with the main attack sonars situated in the bow.

Because the flank sonar arrays 17 should be placed in constant-diameter hull sections, the forward MBT section 13 should begin to taper into an elliptical closure just forward of the said transverse bulkhead. Similarly, the after MBT area 18 should begin to taper into a parabolic closure after the corresponding aft transverse bulkhead (FIGS. 1 and 2).

In many submarine designs, the forward and after hull structures begin to taper where these unite with the pressure hull. This can give rise to severe welding problems because of the narrow angle formed where these structures meet. An additional advantage of the construction proposed above is that these problems would be reduced. However, the resultant water capacity of the areas outside the pressure hulls is probably greater than what would be considered necessary, even in a submarine with a relatively high ROB, if they were to be dedicated only to MBTs. The following two sections explain what can be done to better utilize these spaces.

Trim and compensation tank

Because of the two PH construction, the location of the Trim and Compensation tanks (TC tanks) poses certain problems. In a more conventional single PH design, the main trim tanks are located at the lower parts of the extreme ends of the pressure hull. The compensation tank is located midship and is usually integrated with the "D" tanks. The compensation tank is usually a "hard" tank capable of withstanding full sea pressure and is connected to large pumps that can empty it. The Trim tanks are "soft" structures that operate at the interior hull pressure. In response to shifts in the centre of gravity due to movement of crew and equipment, consumption of stores, etc . . . , water can be pumped from one trim tank at one end of the submarine to the other. If there is a change in the buoyancy of the submarine, the compensation tank can take in or pump out the required amount of water. The systems are interconnected so that the compensation tanks can feed water to the trim tank system as needed.

Correct trim is achieved when the centre of buoyancy is longitudinally in line with the centre of gravity. Theoretically, a submarine in trim can "hover" while submerged and motionless. In practice, because there is always movement of crew, equipment and stores, in addition to compressibility effects, a submarine is unstable when motionless and submerged. If the submarine has forward motion, these small changes can usually be compensated by the hydroplanes. If the submarine is at periscope depth, wave action will also affect the attitude of the submarine. Use of the TC tanks to hover may be impractical because of the large and noisy pumps that have to be operated intermittently. For these reasons, many submarines are equipped with hover tanks. These tanks can be located at the fore and aft ends of the submarine, outside the PH, where they have to be pressurized to ambient sea pressure so that the transfer of water can be effected against a zero pressure differential. In this manner, small, quiet pumps can be used.

There are two alternatives for the arrangement of the trim and compensation tanks in this design:

1. The more conventional approach is to equip each PH with a complete system. To shift weight, for example, from the forward to the after part of the boat, water from the forward trim tank of each PH is pumped to its corresponding aft trim tank. This arrangement requires a total TC tank system somewhat larger than in a conventional single PH submarine design.

2. The preferable alternative is to put three trim tanks 23, 19, 43 outside the pressure hull in the forward, after and midship MBT areas where they can be pressurized to ambient sea pressure. In this manner, the trim tanks can also be connected to the HP air system so they can be "blown" to give additional buoyancy in case of an emergency and, by the use of small, quiet pumps, also act as hover tanks. Furthermore, there is no need to connect the tanks. To shift weight from one end of the submarine to another, it is sufficient to pump some water out of one end tank and take in the same amount into the other end. Changes in buoyancy can be met by the midship compensation tanks 43 which can also act as "D" tanks—particularly if the position of these tanks is close to the centre of buoyancy of the submarine. The three tanks should be sized to ensure that, should one be rendered inoperative, the other two can still maintain some measure of trim in most circumstances. Evidently, some method to prevent sloshing must be used. The trim tanks may occupy the remaining space that encloses the PH caps, the flank sonar arrays 17 and the free-flood mast areas 25, 34 (FIGS. 1 and 3).

Although not essential, an external TC tank system is certainly a desirable feature. The hover tanks on which they are based are relatively small tanks that are not considered crucial to the safety or integrity of the submarine. Placing these tanks over three main areas of the submarine, equipping them with a redundant number of pumps and oversizing them somewhat, should ensure that reasonable safety standards or criteria can be met. In addition, it may be necessary to provide the submarine with a larger than normal HP air-bottle capacity to ensure that a sufficient number of emergency blows are always available for the MBTs even after a prolonged submerged navigation without the use of the air compressors.

An air venting system is necessary for operating the external TC tank system (in addition to the HLS tubes and the WC tanks). This system may vent into special tanks inside the PHs where, at convenient moments, this air may be reprocessed into HP air.

Auxiliary fuel tank

In order to take the maximum advantage of the two PH construction, the auxiliary fuel tank 42 should be located in the space between the two main PHs 11, 12. One of the two aforementioned areas that enclose the midship PH caps could use the remaining space for this purpose (FIG. 3). By placing this tank 42 outside the pressure hull, it can also be connected to the HP air system so as to provide increased buoyancy in case of an emergency blow. It is particularly preferred that this feature is provided in a nuclear powered submarine, although it could also be provided in a submarine powered by other means.

Superstructure

Whereas on a large submarine the curvature of the hull may be shallow enough to permit the crew to walk on the topdeck when the submarine is docked or navigating on the surface, this may not be possible on a 25-foot hull. It would also be a good idea to have some of the hydraulic and HP air lines outside the PHs. Furthermore, it would be desirable to be able to house in a smooth surface all the cleats, chocks, capstans, hatches, MBT vent valves, safety tracks, etc . . . that are necessary on the topdeck of all submarines as well as the shutters for the periscopes and masts. In addition, because the ESM 15 will probably bulge out above the main pressure hull line, a structure for fairing it in smoothly is necessary (FIG. 3). Finally, due to the lack of a bridge fin, a place must be found to house high-frequency navigation sonars and receivers.

For all these reasons, a free-flood superstructure 29 should be provided. This superstructure 29 is also the logical place for the forward hydroplanes 14 (FIGS. 1 and 2). By placing them on the superstructure, they can be set far enough away from the forward sonar arrays to avoid interfering hydrodynamic noise and yet still be at or in front of the neutral point. In this position they would also be above the plane of the after hydroplanes and propulsor in order to minimize any possible tip vortex interference.

Because of the space required by the midship free-flood mast areas 25 and the ESM's superstructure, there will probably be a break in the submarine's superstructure in the midship area. Due to the lack of sufficient superstructure length that would result from this break, towed arrays may have to be housed only in spools or reels in the after MBT areas 18. This may pose a problem for thick-line arrays such as the TB-16. If necessary, the superstructure casing may be made wide enough to accommodate this dispenser or a special housing added to one side, thus giving the superstructure an asymmetric shape.

Ship control

The elimination of the bridge fin should end the possibility of snap-roll. Ship control can be simplified and one-man operation should be possible without undue reliance on computers and program logic. In addition, the elimination of snap-roll may bring new opportunities for incorporating alternative stern control-surface arrangements which are hydrodynamically superior such as the X and the inverted Y. Should the software or the computers that are necessary for these stern arrangements fail, there should be less risk for the submarine. Furthermore, the reliability of the program logic should benefit from the simplification brought on by the elimination of the lift parameters created by a bridge fin when the submarine heels into a turn.

Structural considerations

The 10 longitudinal stiffeners in the midship area are simply the natural places where these can be located without complicating the drawings too much. To ensure adequate longitudinal rigidity, additional stiffeners may be needed. The design contemplates the possibility of using the yoke and tube structure of the HLS and the external hull to form a type of torsion box construction to unite the two main PHs. The ESM bed, the WC tanks and the central yokes form a structure that should contribute substantially towards longitudinal rigidity in the more vertical planes. In any case, ensuring sufficient longitudinal rigidity and shock resistance to the structures that unite the two main PHs is a major challenge that will need to be resolved.

The two PH configuration effectively replaces the need for a very heavy midship bulkhead capable of withstanding full crush depth. Modern U.S. submarines are required to have such a bulkhead in order to permit survival of the crew should the PH be breached and the submarine sink in shallow waters.

Application Example

Though the inventor lacks the necessary means to be able to give more than a first (and rough) approximation for the appropriate sizing of the main elements in this design, the exercise is worthwhile as it gives an idea of what the finished product may look like and if any impractical features (such as a too large a length/diameter ratio) may crop up. The first assumption made is that the submarine is a SSN though the design should be adaptable for SSKs as well. Other assumptions are as follows:

1. That there are no extraordinary requirements as to speed or deep diving ability.

2. That the after PH should hold about 60% of all the interior PH volume (not counting the ESM) and that the weight of the main machinery and after auxiliary systems will give an average density for the volume enclosed by this PH of about 60% that of water (internal diameter is taken to be 98.4% of the external hull diameter). In addition, it is likely that the reactor and main machinery will impose a minimum length requirement on this PH.

3. That the forward PH holds the remaining 40% of the PH volume and that the weight of its components (forward auxiliary systems, accommodation, galley, stores, control room, sonar and communications equipment, HLS control room, etc . . . ) gives an average density for the volume enclosed by this PH of about 37% that of water.

4. That the pumps and equipment in the ESM gives an average density for the volume enclosed by this PH of about 25% that of water.

5. That the HLS has a total capacity of 32 tubes. In addition, that these tubes need an interior length of 21 feet, an external diameter of 24 inches and that the entire assembly (including doors, caps, HP air and vent mechanisms) can be made to fit inside a 25-foot-diameter hull.

6. That we will ultimately be dealing with a submarine of around 2500 tons surfaced displacement (standard condition) and that the total crew should be in the order of 65 persons.

7. That about 7% of the surfaced displacement will be taken up by permanent ballast at the forward MBT area to bring the longitudinal centre of gravity in line with the centre of buoyancy and to place them just after the midship MBT area.

8. That all the Pressure Hull assemblies (including the ESM) and structures will represent about 45% of the surfaced displacement.

9. That everything else that is not contained within the PHs (control mechanisms, HP air bottles, masts, sensors, propulsor, HLS, fittings, etc.) will represent about 8% of the surfaced displacement of the submarine.

10. That the ROB needs to be at least 15% of the surfaced displacement in order for the HLS reload system to work as intended.

The result is a design with a forward PH of about 66 feet in length and an after PH about 95 feet long. The shortest distance between the two main PHs is about 23 feet. In summary, the end product should have an overall length of about 262 feet and a beam of 25 feet which gives it a l/d ratio comparable to many modern SSNs. Total submerged displacement is approximately 3350 tons and surfaced 2550 (standard condition). Total MBT capacity is about 500 tons of which the midship MBTs account for about 115 tons (assuming the WRT tanks are not installed). The variable ballast (external TC and WC tanks) and the free-flood capacity are approximately 200 tons each.

Should the after PH be too short, a bottlenose shape (with the narrow end towards the stern) may be more suitable for this vessel as it allows for a longer PH without increasing its volume. This arrangement still permits in-line placement of the after flank arrays (although somewhat further forward) while allowing for a more tapered stern and a shorter shaft. On the other hand, there is a weight penalty associated with this shape and the two after mast areas may have to be sacrificed.

A power plant similar to that used in the French Rubis and Amethyst class SSNs could be used. This power plant is reputed to deliver about 9,500 SHp. It may need to be upgraded somewhat because, although there is less drag due to the absence of a bridge fin, there is an increase in displacement. The point to be made here is that there is a major NATO partner in possession of a power plant designed to fit inside a 25-foot-diameter pressure hull. The existence of this power plant could go a long way towards reducing the development time required for a new power plant to fit this hull. It is also worth mentioning that, reputedly, in August 1955, Electric Boat presented several power plant designs based on the AFSR reactor (later developed as the S5W). Some of these designs were to fit a lengthened 25-foot-diameter Skate class submarine hull and included versions with 12,000 and 15,000 SHp. With the technology available 40 years later, it should be possible to boost these figures somewhat. In any case, the reactor and the primary systems that need heavy shielding should be placed as far forward as possible.

The forward PH should have sufficient capacity to eliminate the need for hot-bunking—if the figure of 65 crew members is correct and if the recommended external TC tank system is adopted.

It should be noted that, in this approximation, the ESM has a capacity to accommodate over 85 persons in an emergency and, by using the top row of fold-away bunks, up to 6 injured crew could make the trip to the surface lying down without seriously affecting the salvage capacity. In normal use, the ESM can fit 18 "temporary" bunks while still maintaining sufficient aisle space.

This bunk space has not been accounted for when sizing the forward PH. With regard to divers, SEALS or other teams that may be delivered while submerged, capacity will, of course, depend on the amount and bulk of equipment these may carry. In any case, at least 35 normally equipped divers may be delivered or recovered in one single flooding/emptying cycle of the ESM.

It would be desirable to retain one conventional escape trunk for those situations where only two or three divers need to be delivered and to act as a secondary or backup escape system. Since the after PH needs some method of access from the exterior when the submarine is surfaced, this trunk should probably be placed there.

The permanent ballast should be placed below the hull axis to ensure that the centre of gravity is below the centre of buoyancy. However, care must be taken to ensure that, while surfaced, BG is not so great that it will prevent the HLS reload system from working as intended.

Total submerged draught is about 28 feet. Due to the relatively high ROB, freeboard can be quite generous and the submarine should draw about 18 or 19 feet of water when surfaced. While underway on the surface, it may be desirable to flood some MBTs to ensure the propulsor is submerged.

The three recessed flank arrays on each side of the submarine are set approximately equidistant to one another and arranged symmetrically along the hull axis. There is space for two additional arrays just forward of the HLS.

It is likely that the best place for the control room is in the forward part of the upper level of the forward PH. In this way, the control room is in a cul-de-sac and not in a passageway. The sonar and radio rooms can be after the control room. Officers quarters, wardroom, offices, etc . . . can occupy the space further aft. The forward part of the middle level can house the sonar equipment room while the after part may hold the HLS control room. The rest of the middle level can be taken up with berthing, mess, galley and cold stores. The lower level should house the auxiliary systems.

A 25-foot-diameter hull may not be able to accommodate the same degree of noise reduction equipment that can be fitted in a 40-foot hull. However, achieving acceptable radiated noise levels is a challenge that should be attainable with existing technology. On the other hand, due to its relatively small size, detection by non-acoustic means and by active sonars should be more difficult.

Should full under-ice capabilities be desired, the following areas will need special consideration:

1. The ESM attachment hatches may require significant reinforcement and a strong, heavy cladding may have to be applied to the ESM superstructure.

2. The superstructure may have to be reinforced and therefore heavier than would otherwise be necessary.

3. The ESPB may have to be substantially reinforced. It should be pointed out that, should the ESPB be damaged while it is extended, it may be impossible to retract and the crew may have to cut it free in order for the submarine to submerge.

4. Evidently, the effectiveness of the ESM as an escape mechanism for a submarine patrolling under the polar ice cap is rather limited—unless some method of breaking up thick ice can be incorporated into its design.

The two PH configuration should lend itself well to modern modular construction techniques and may give more flexibility in subcontracting than conventional designs. It should also have additional advantages relative to firefighting, survivability against weapons attack and reactor accidents due to the relatively high ROB, the presence of three main MBT areas and the damage containment offered by separate PHs. In addition, it is particularly suitable for the latest "fly-by-wire" type control systems.

It should be possible to place the reactor manoeuvring room in the forward PH and to further automate the main machinery and the after auxiliary systems so that the after PH will not need to accommodate any watch personnel. In this manner, a certain amount of heavy shielding could be dispensed with. The thickness of the PHs, the distance between them, and auxiliary fuel tank and the structures that make up the midship MBTs and the HLS, should more than compensate for a relatively small reduction in shielding which could, nonetheless, represent significant weight savings. Access would still be needed for maintenance and inspection, but this could be performed by personnel wearing appropriate protective clothing.

While the present invention has been described with reference to one preferred embodiment, it is to be understood that this embodiment is described by way of example only, and does not in any way limit the invention. Once the invention is properly understood, many variations may be made within the spirit and scope of the invention.

I claim:

1. A submarine which has a forward pressure hull, an aft pressure hull, and a third pressure hull vessel which is connectable to the forward and the aft pressure hulls, wherein the submarine is provided with an array of tubes suitable for launching missiles, the tubes being disposed between the forward and the aft pressure hulls, generally around or adjacent to the centre of buoyancy of the submarine.

2. A submarine as claimed in claim 1, wherein the long axes of the tubes are disposed generally horizontally when the submarine is in normal use.

3. A submarine as claimed in claim 2, wherein at least one tube is provided with a connector at or adjacent to the muzzle of the tube for connecting the control wire of a wire-guided torpedo to a fire control system on the submarine.

4. A submarine as claimed in claim 3, wherein the tube contains a wire-guided torpedo which has its wire releasably secured to the side of the torpedo.

5. A submarine as claimed in claim 4, wherein the wire is releasably secured to the side of the torpedo by means of adhesive tape or other releasable adhesive means.

6. A submarine as claimed in claim 2, which has main ballast tanks on both sides, and a sufficient reserve of buoyancy that by flooding main ballast tanks on one side of the submarine, the centre of gravity of the submarine may be shifted sufficiently far as to cause the submarine to roll over on its side so that the tubes are substantially vertical.

7. A submarine as claimed in claim 1, wherein the third pressure hull vessel is sealable and detachable from the submarine, and which has positive buoyancy when sealed and detached, so that it can function as an escape vessel.

8. A submarine as claimed in claim 7, which is provided with means for lifting the third pressure hull vessel so that it clears the submarine hull.

9. A submarine as claimed in claim 8, wherein the lifting means comprises at least one piston.

10. A submarine as claimed in claim 9, wherein two pistons are provided, each one in front of an end cap of the forward and aft pressure hulls and underneath the third pressure hull.

11. A submarine as claimed in claim 1, which is provided with means for blowing pressurised air into one at least one tube so that air which is blown into the tube pushes a plate which launches a missile from the tube.

12. A submarine as claimed in claim 11, wherein the tube is provided with an internal ring which narrows the internal dimensions of the tube to those of a conventional torpedo tube, and which is adapted to form a seal with the plate when the plate is urged into contact with the ring.

13. A submarine as claimed in claim 11, wherein the tube is provided with rearward valve means whereby after firing of a missile the air pressure in the tube may be reduced so as to allow the plate to be pushed backwards by sea pressure.

14. A submarine as claimed in claim 11, wherein the internal ring is provided with at least one gap to permit a wire to pass through when launching a wire-guided torpedo.

15. A submarine as claimed in claim 1, wherein one or more compensation tanks are provided, which may be filled with and emptied of water to compensate for any difference between the weight of a missile in a tube and sea water which subsequently replaces the missile.

16. A submarine as claimed in claim 1, wherein the forward pressure hull is provided with a viewing tube mounted generally vertically on the axis of the submarine and adapted to be raised through a hatch in the top of the pressure hull so that a crew member located inside the viewing tube may look outside the submarine.

17. A submarine as claimed in claim 1, wherein the forward pressure hull and the aft pressure hull each have a forward trim tank and an aft trim tank, and means for pumping water from one to the other to compensate for changes of centre of gravity of the submarine.

18. A submarine as claimed in claim 1, which is provided with three trim tanks, located outside the pressure hulls, in forward, rear, and midship MBT areas where they can be pressurised to ambient sea pressure.

19. A submarine as claimed in claim 18, wherein the trim tanks are connected to a high pressure air system so that they can be "blown" to give additional buoyancy.

20. A submarine as claimed in claim 18, wherein the trim tanks are connected to one or more conventional pumps so that the trim tanks may act as hover tanks.

21. A submarine as claimed in claim 1, wherein an auxiliary fuel tank is located in a space between the forward and aft pressure hulls.

22. A submarine as claimed in claim 21, wherein the submarine is nuclear powered and wherein the auxiliary fuel tank is connected to a high pressure air system so that it can be "blown" to give additional buoyancy.

23. A submarine as claimed in claim 1, wherein a free-flooding space is provided between the forward and the aft pressure hulls, suitable for housing periscopes, snorkels, antenna, other masts, and similar equipment.

24. A submarine as claimed in claim 1, wherein at least one recessed sensing device are housed in the space between the forward and aft pressure hulls.

25. A submarine as claimed in claim 24, wherein the sensing device is a sonar array.

26. A submarine as claimed in claim 1, wherein at least one tube contains a missile or torpedo which is immersed in a liquid contained in the tube.

27. A submarine as claimed in claim 26, wherein the liquid contains an anti-corrosion additive.

28. A submarine as claimed in claim 26, wherein the liquid is water.

* * * * *

UNITED STATES PATENT AND TRADEMARK OFFICE

CERTIFICATE OF CORRRECTION

PATENT NO. : 5,979,354
DATED : November 9, 1999
INVENTOR(S) : Javier Silvano Arzola

It is certified that error appears in the above-identified patent and that said Letters Patent is hereby corrected as shown below:

On the title page: Item [56] insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 5 | 4 | 6 | 2 | 0 | 0 | 3 | 10/95 | Fox et al. | | | |
| | | 1 | 7 | 9 | 7 | 7 | 7 | 0 | 3/31 | Gunning | | | |

UNITED STATES PATENT AND TRADEMARK OFFICE

CERTIFICATE OF CORRRECTION

PATENT NO. : 5,979,354
DATED : November 9, 1999
INVENTOR(S) : Javier Silvano Arzola

It is certified that error appears in the above-identified patent and that said Letters Patent is hereby corrected as shown below:

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | FR | 2 | 5 | 1 | 2 | 7 | 7 3 | A | 3/83 | FRANCE | | | | |
| | JP | 63 | 1 | 7 | 6 | 7 | 9 8 | A | 11/88 | JAPAN | | | | |
| | BE | 3 | 9 | 3 | 1 | 5 | 0 | A | 2/1 | BELGIUM | | | | |
| | CH | 1 | 3 | 5 | 3 | 7 | 4 | A | 2/1 | SWITZERLAND | | | | |
| | GB | 1 | 0 | 3 | 5 | 1 | 6 | A | 2/17 | GREAT BRITAIN | | | | |
| | DE | 2 | 0 | 0 | 1 | 5 | 5 1 | A | 7/71 | GERMANY | | | | |

Signed and Sealed this

Eighteenth Day of July, 2000

*Attest:*

*Attesting Officer*

Q. TODD DICKINSON

*Director of Patents and Trademarks*